US009263005B1

(12) United States Patent
Moushon et al.

(10) Patent No.: US 9,263,005 B1
(45) Date of Patent: Feb. 16, 2016

(54) APPARATUS AND METHODS FOR ALTERING TONAL CHARACTERISTICS OF A STRINGED MUSICAL INSTRUMENT

(71) Applicants: Gaylan Moushon, Washington, IL (US); Tim Wallis, East Peoria, IL (US)

(72) Inventors: Gaylan Moushon, Washington, IL (US); Tim Wallis, East Peoria, IL (US)

( * ) Notice: Subject to any disclaimer, the term of this patent is extended or adjusted under 35 U.S.C. 154(b) by 0 days.

(21) Appl. No.: 14/469,022

(22) Filed: Aug. 26, 2014

(51) Int. Cl.
*G10D 3/00* (2006.01)
*G10D 3/14* (2006.01)

(52) U.S. Cl.
CPC . *G10D 3/143* (2013.01); *G10D 3/00* (2013.01)

(58) Field of Classification Search
CPC ..... G10D 3/00
See application file for complete search history.

(56) References Cited

U.S. PATENT DOCUMENTS

| | | | | | |
|---|---|---|---|---|---|
| 1,926,561 | A | | 9/1933 | Schrickel | |
| 2,021,641 | A | * | 11/1935 | Spina | 84/319 |
| 2,025,786 | A | * | 12/1935 | Spina | 84/319 |
| 2,026,354 | A | | 12/1935 | Mihalek | |
| 2,027,937 | A | * | 1/1936 | Schrickel | 84/319 |
| 2,082,683 | A | | 6/1937 | Carter | |
| 2,461,232 | A | | 2/1949 | Pulsifer | |
| 2,647,429 | A | * | 8/1953 | Smith | 84/319 |
| 2,650,513 | A | * | 9/1953 | Miller | 84/319 |
| 3,386,325 | A | | 6/1968 | Smith | |
| 3,822,629 | A | * | 7/1974 | Smith | 84/319 |
| 4,328,733 | A | * | 5/1982 | Smith | 84/319 |
| 4,471,682 | A | * | 9/1984 | Bozung | 84/319 |
| 6,297,435 | B1 | * | 10/2001 | Gutowski | 84/315 |
| 6,369,307 | B1 | | 4/2002 | Wells | |
| 8,217,246 | B2 | * | 7/2012 | Sangster | 84/315 |
| 8,618,391 | B1 | * | 12/2013 | Roberts | G10D 3/00 84/315 |
| 2011/0005368 | A1 | | 1/2011 | Sangster | |

* cited by examiner

*Primary Examiner* — Robert W Horn
(74) *Attorney, Agent, or Firm* — Miller, Matthias & Hull LLP

(57) ABSTRACT

Apparatus and methods for altering the tonal characteristics of output of a stringed instrument are disclosed. The stringed instrument may include a neck and a plurality of strings, the plurality of strings disposed about the neck. The apparatus may include a slide bar, the slide bar for contacting one or more strings of the plurality of strings and a support arm attached to the slide bar. The apparatus includes a retractable string depressor retractably connected to the support bar, the retractable string depressor for depressing one or more strings of the plurality of strings at a location on the neck forward of the slide bar.

20 Claims, 6 Drawing Sheets

APPARATUS AND METHODS FOR ALTERING TONAL CHARACTERISTICS OF A STRINGED MUSICAL INSTRUMENT

TECHNICAL FIELD OF THE DISCLOSURE

The present disclosure relates to stringed musical instruments and, more particularly, to apparatus and methods for altering tonal characteristics of a stringed musical instrument.

BACKGROUND OF THE DISCLOSURE

Various stringed instruments may be tuned to produce specific output having tonal characteristics like, for example, a chord. The strings of the instrument may be tuned to produce a specific chord when strummed "open," meaning with no strings depressed on a neck of the instrument. Some common open-chord tunings include an Open E tuning, an Open G tuning, an Open D tuning, a C6th tuning, E9th tuning, and the like. The key of the open chord and/or the chord itself may be altered by the player of the instrument pressing a plurality of strings at one or more positions on a neck of said instrument.

A variety of stringed instruments may implement such chord-based tuning, such as, but not limited to, a slide guitar, a lap steel, a Hawaiian steel guitar, a dobro, a resonator, and the like. Often, when playing instruments having open chord tunings, a slide bar is used to manipulate tonal characteristics of the instrument's output by pressing the slide against one or more of the strings and moving (or "sliding") the slide about a neck of the instrument. In standard use, a standard slide will depress all the strings on the neck of a stringed instrument, effectively changing the key of the "open" version of instrument's tuning. However, a standard slide bar may limit the tonal choices of the player, making it difficult, or even impossible, to play some commonly used chords or desired string pitch changes within a chord.

While several devices have attempted to overcome the chord limitations of the standard slide, while also maintaining the tonal advantages of the standard slide, such designs are either expensive, difficult to use, or not able to reliably produce desired chords and output. For example, a pedal steel guitar may use a slide for changing the tonal chord on the strings while the user has access to pedals associated with the guitar that alter one or more strings to produce chords, optionally including desired pitch changes of one or more of the strings within a chord, not normally achievable with the standard slide alone. However, pedal slide guitars are, generally, much more expensive than a standard slide guitar as well as more complicated to play given the involvement of the hands, knees and feet. Such systems are also are also very reliant on the skilled hand and dexterity of the user.

Therefore, improved apparatus and methods for altering the tonal characteristics of a stringed instrument while using a slide-based apparatus are needed.

SUMMARY OF THE DISCLOSURE

In accordance with one aspect of the disclosure, apparatus for altering the tonal characteristics of output of a stringed instrument is disclosed. The stringed instrument may include a neck and a plurality of strings, the plurality of strings disposed about the neck. The apparatus may include a slide bar, the slide bar for contacting one or more strings of the plurality of strings and a support arm attached to the slide bar. The apparatus may include a retractable string depressor retractably connected to the support arm, the retractable string depressor for depressing one or more strings of the plurality of strings at a location on the neck forward of the slide bar. The apparatus may include a finger rest formed at an intersection of the slide bar and the support arm. In some examples the apparatus may include a thumb rest associated with the retractable string depressor and, optionally, the retractable string depressor may be repositionable using the thumb rest. The retractable string depressor may be retractably connected to the support arm by using a pivot.

In accordance with another aspect of the disclosure, another apparatus for altering the tonal characteristics of output of a stringed instrument is disclosed. The stringed instrument may include a neck and a plurality of strings, the plurality of strings disposed about the neck. The apparatus may include a slide bar, the slide bar for contacting one or more strings of the plurality of strings, a support arm attached to the slide bar, and a movable arm attached to the support bar. The apparatus may include a retractable string depressor retractably connected to the movable arm, the retractable string depressor for depressing one or more strings of the plurality of strings at a location on the neck forward of the slide bar. The apparatus may further include a control linkage attached to both the support arm and the retractable string depressor. In an embodiment, the retractable string depressor may include a contoured contact surface. The contoured contact surface may include a substantially flat surface and a substantially arced surface.

In accordance with yet another aspect of the disclosure, a method for altering the tonal characteristics of output of a stringed instrument is disclosed. The stringed instrument may include a neck and a plurality of strings, the plurality of strings disposed about the neck. The method may include depressing one or more strings of the plurality of strings using a slide bar, positioning a retractable string depressor to a location forward of the slide bar on the neck, the retractable string depressor in retractable connection with the slide bar, and depressing one or more strings at the location forward of the slide bar on the neck. The retractable string depressor may be in connection with the slide bar via a support arm. Alternatively, the retractable string depressor may be in connection with the slide bar via a movable arm and a support arm, the movable attached to the support arm and the support arm attached to the slide bar. Further, the positioning of the retractable string depressor may be performed using a thumb rest associated with the retractable string depressor.

These and other aspects and features of the present disclosure will be more readily understood when read in conjunction with the accompanying drawings.

It should be understood that the drawings are not necessarily to scale and that the disclosed embodiments are sometimes illustrated diagrammatically and in partial views. In certain instances, details which are not necessary for an understanding of this disclosure or which render other details difficult to perceive may have been omitted. It should be understood, of course, that this disclosure is not limited to the particular embodiments illustrated herein.

DETAILED DESCRIPTION OF THE DISCLOSURE

The disclosed embodiments provide apparatus and methods for altering tonal characteristics of a stringed instrument, specifically the output of a stringed instrument. Such apparatus are designed to improve upon the standard slide bars used for stringed instruments by providing implements for depressing one or more strings at a position forward of a slide or bar. Such implements are designed such that the one or more strings may be depressed while the slide or bar remains touching all the strings of the instrument. While the disclosed embodiments often refer to depressing one or more strings forward of a slide bar while the slide bar depresses one or more strings, the following embodied apparatus may certainly be used to depress one or more strings while the slide bar is not in contact with the strings.

Figure 1:
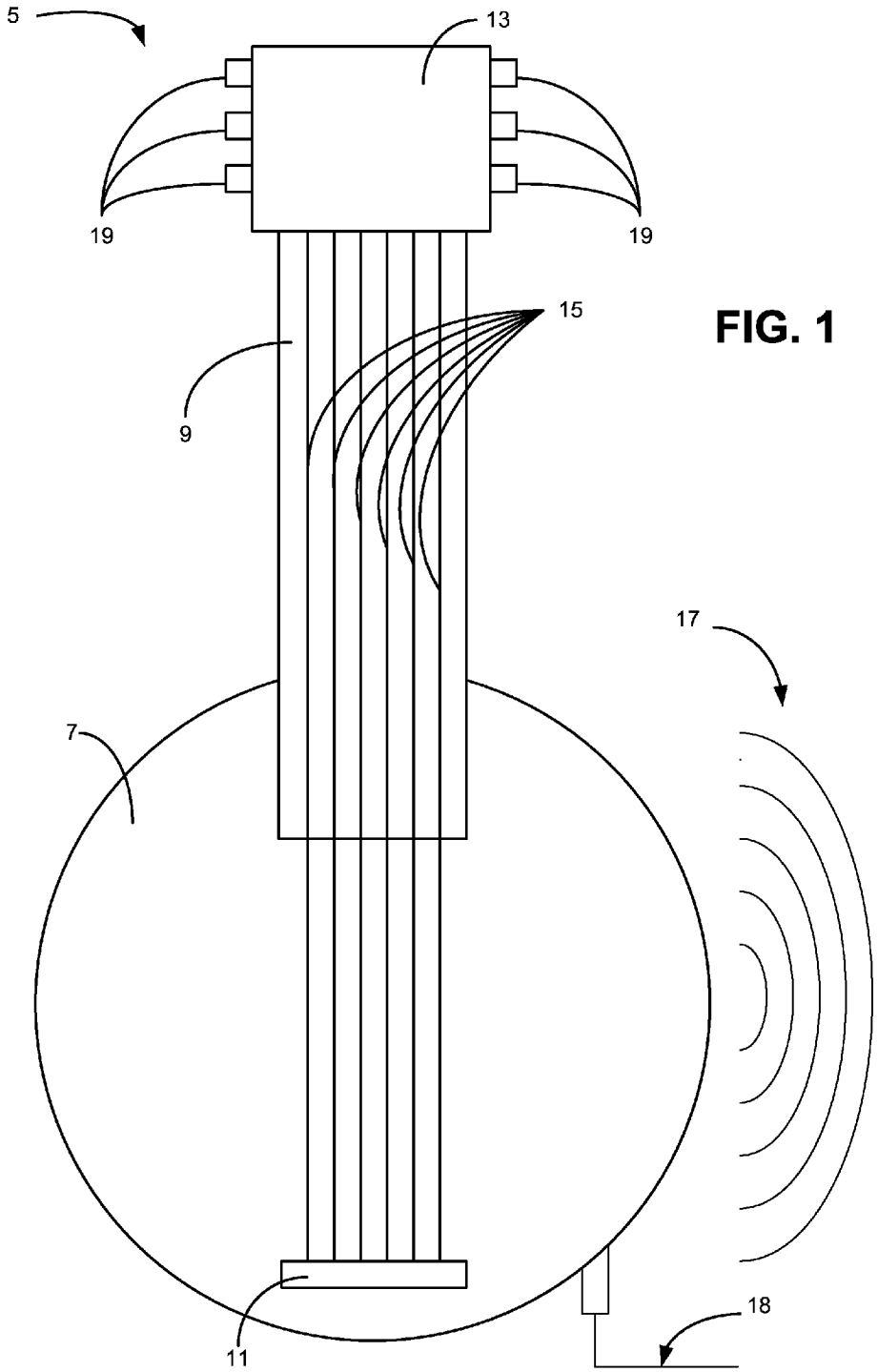
FIG. 1 is a schematic diagram of an example stringed instrument, with which the example embodiments of the present disclosure may be used.

Referring now to the drawings, and with specific reference to FIG. 1, a stringed musical instrument 5, on which embodiments of the present disclosure may be used, is shown. The stringed instrument 5 may be representative of any stringed instrument, such as, but not limited to, a slide guitar, a lap steel guitar, a Hawaiian steel guitar, a dobro, a resonator, or any other stringed instrument having a fretted or unfretted neck.

The stringed musical instrument 5 includes a body 7, from which a neck 9, which may also be a "fretboard," extends between a bridge 11 and a head 13. Strung along the neck 9, the stringed instrument 5 includes a plurality of strings 15, with one or more of the strings 15 producing at least one of an acoustic tonal output 17 and an electrical tonal output 18 when plucked, strummed, or otherwise contacted in a manner to produce an output. A plurality of tuning pegs 19 may be provided to adjust the tension in each of the strings 15 as readily known by those of ordinary skill in the art. The tonal output 17, 18 may be altered by a user depressing one or more of the strings 15 at one or more positions on the neck 15. While six strings are shown in the plurality of strings 15 in the embodiment of FIG. 1, the musical instrument 5 is certainly not limited to having six strings and may have any number of strings.

Figure 2:
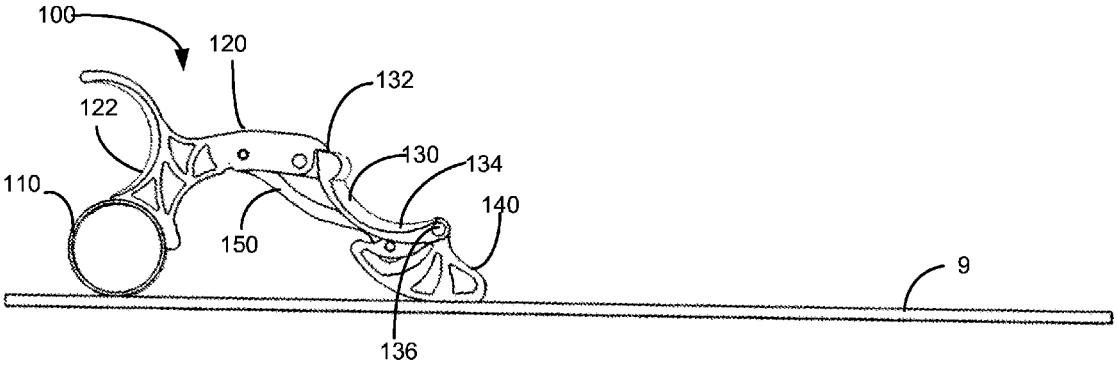
FIG. 2 is a side view of an example device for altering tonal characteristics of output of a stringed instrument, in accordance with an embodiment.
Figure 3:
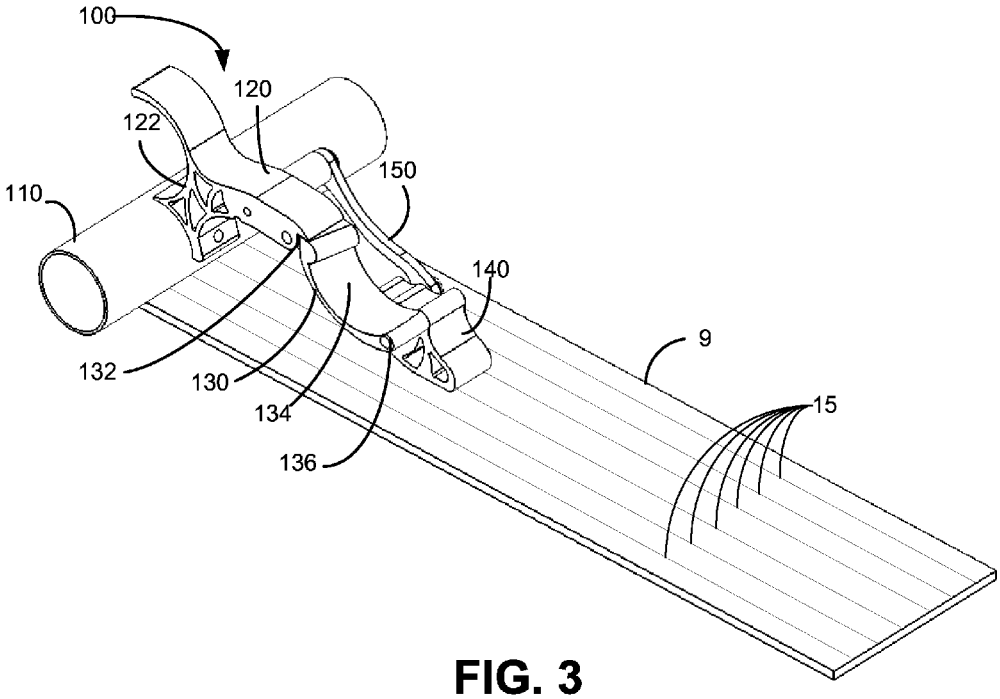
FIG. 3 is a perspective view of the example device for altering tonal characteristics of output of a stringed instrument in accordance with the embodiment of FIG. 2.

FIGS. 2 and 3 show an embodiment of an apparatus 100 for altering the tonal characteristics of the output 17, 18 of the stringed instrument 5. The apparatus 100 includes a bar 110, which may be comparable to any design used for a standard slide bar. The bar 110 may be a solid bar, it may have a portion of the materials removed, it may be cylindrical, and/or it may be hollow. Further, the bar 110 may be any other shape, such as, but not limited to, a generally rectangular shape. In addition to the bar 110, the apparatus 100 includes a support arm 120. The support arm 120 may include a finger rest 122, which may be a groove in the structure at the intersection of the bar 110 and support arm 120 at which a user of the apparatus 100 may rest one or more fingers (e.g., an index, middle or ring finger) while using the apparatus 100. The support arm 120 is attached to the bar 110 by any suitable method of attachment (e.g., bolting, welding, adhesively attaching, forming synchronously with the bar, etc.).

The apparatus 100 further includes a movable arm 130 hinged to the support arm 120 at pivot 132. The pivot 132 may be spring biased to hold the movable arm 130 in any desired starting position when a user has not applied pressure to the movable arm 130. For example, the pivot 132 may spring bias the movable arm 130 to a forward-extended position. A user may pivotally reposition the movable arm 130 by applying pressure at a thumb stop 134, on which the user may rest his/her thumb, or any other fingers, during use.

At a distal end 136 of the movable arm 130, a contoured string depressor 140 is pivotally attached. The contoured string depressor 140 may be used for depressing one or more strings 15 associated with the neck 9 at a location forward of the bar 110. In use, the contoured string depressor 140 may be moved forward along the neck 9 with or without moving the bar 110, as the string depressor 140 is retractable with respect to the support arm 120 via the movable arm 130. For example, the thumb stop 134 may be used by the user as a point of contact with which to move the movable arm 130, which, in turn, may position the contoured string depressor 140. In addition, although not necessary, FIG. 3 shows the contoured string depressor 140 to be wide enough to simultaneously depress two strings 15 at a time, and narrow enough to depress only one string 15 of desired. In other embodiments, other widths for the contoured string depressor 140 are possible.

Figure 4:
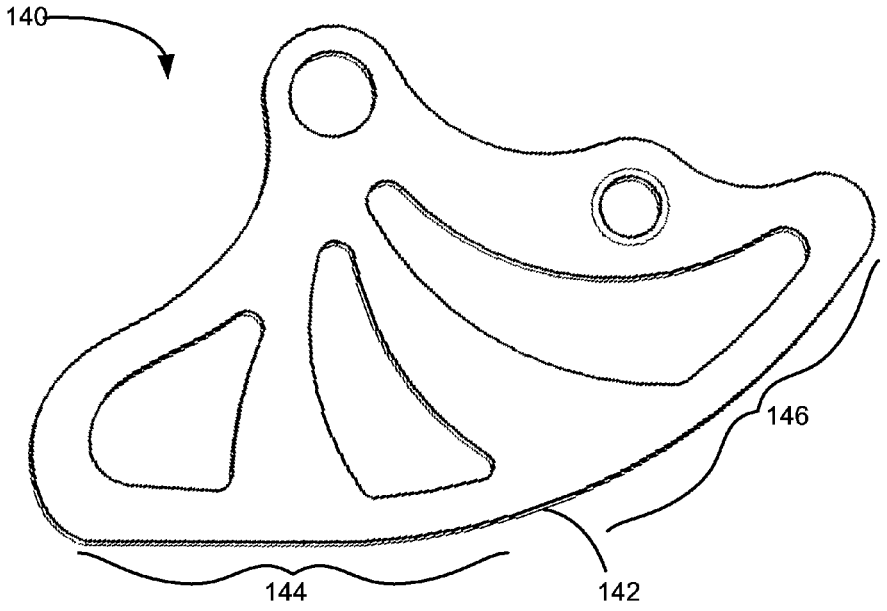
FIG. 4 is a side view of an example string depressor of the example device for altering tonal characteristics of output of a stringed instrument in accordance with the embodiment of FIGS. 2 and 3.

As shown in greater detail in FIG. 4, the contoured string depressor 140 includes a contoured contact surface 142. The contoured contact surface 142 is contoured so as to optimize the potential contact with the one or more strings 15 to be depressed at a location forward of the bar 110. The contoured surface 140 may be contoured in any manner suitable for depressing strings, like, for example, a contour emulating the shape of a human finger. In the depicted embodiment, illustrated most clearly in FIG. 4, the contoured contact surface 142 may include a generally flat surface 144 and a continuously arced surface 146. Such a design allows for proper pressure distribution on one or more strings 15 at a point forward of the bar 110, preventing undesired loss of pressure on the one or more depressed strings.

For further securing the contoured string depressor 140 to the support arm 120, the apparatus 100 may further include a control linkage 150. The control linkage 150 is attached to both the string depressor 140 and the support arm 120. In use, the control linkage 150 may provide support for aligning the contoured string depressor 140 and preventing unwanted lateral slippage of the contoured string depressor 140, with respect to the neck 9. Connections from the control linkage 150 to both the support arm 120 and the string depressor 140 are made in a manner that allows for retractable movement (e.g., rotatable bolting). The control linkage 150 may be beneficial for increasing the tonal range for desired output because the user's required range of motion for a given point of contact on the neck 9 via the sting depressor 140 may be lessened with used of the control linkage 150.

Figure 5:
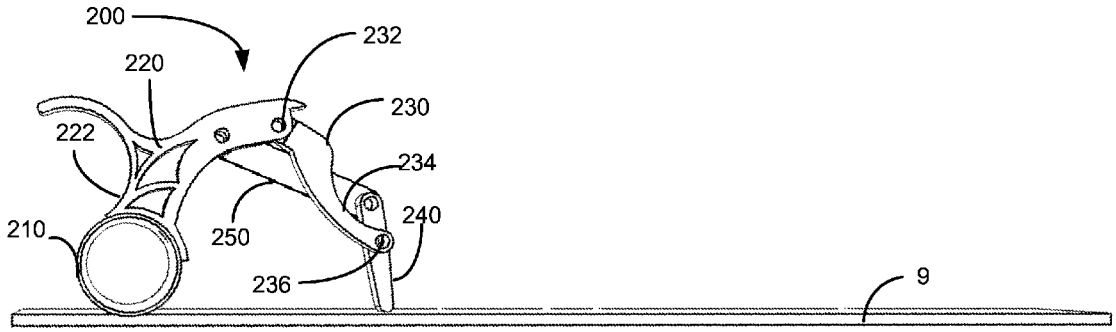
FIG. 5 is a side view of an example device for altering tonal characteristics of output of a stringed instrument, in accordance with another embodiment.
Figure 6:
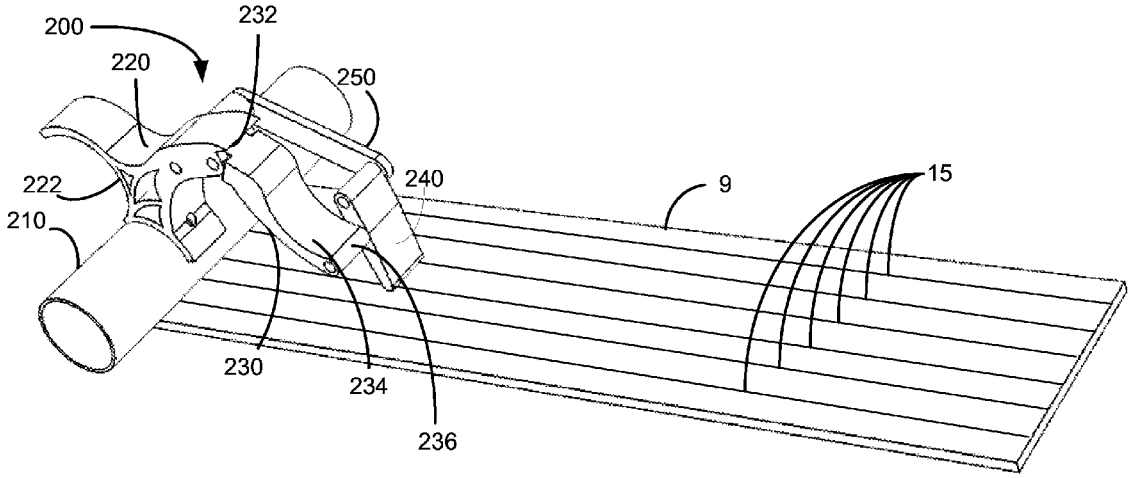
FIG. 6 is a perspective view of the example device for altering tonal characteristics of output of a stringed instrument in accordance with the embodiment of FIG. 5.

Turning now to FIGS. 5 and 6, an embodiment of another apparatus 200 for altering the tonal characteristics of the output 17, 18 of the stringed instrument 5 is shown. The apparatus 200 includes a bar 210, similar to the bar 110 of FIGS. 2 and 3, which may be comparable to any design used for a standard slide bar, as described above in more detail with respect to FIGS. 2 and 3. In addition to the bar 210, the apparatus 200 includes a support arm 220. The support arm 220 may include a finger rest 222, which may be a groove in the structure at the intersection of the bar 210 and support arm 220 at which a user of the apparatus 200 may rest one or more fingers (e.g., an index finger) while using the apparatus 200. The support arm 220 is attached to the bar 210 by any suitable method of attachment (e.g., bolting, welding, adhesively attaching, forming synchronously with the bar, etc.).

Similar to the first embodiment, apparatus 200 further includes movable arm 230 hinged to the support arm 220 at pivot 232. The pivot 232 may be spring biased to hold the movable arm 230 in any desired starting position when a user has not applied pressure to the movable arm 230. For example, the pivot 232 may spring bias the movable arm 230 to a forward-extended position. A user may pivotally reposition the movable arm 230 by applying pressure at a thumb stop 234, on which the user may rest his/her thumb, or any other fingers, during use.

Also, similar to the first embodiment, at a distal end 236 of the movable arm 230, a string depressor 240 is again pivotally attached but in a different shape. More specifically, as will be noted, the string depressor is more planar in shape. The string depressor 240 may be used for depressing one or more strings 15 associated with the neck 9 at a location forward of the bar 210. In use, the contoured string depressor 240 may be moved forward along the neck 9 without moving the bar 210, as the string depressor 240 is retractable with respect to the support arm 220 via the movable arm 230. For example, the thumb stop 234 may be used by the user as a point of contact with which to move the movable arm 230, which, in turn, may position the contoured string depressor 240.

For further securing the string depressor 240 to the support arm 220, the apparatus 200 may further include a control linkage 250. The control linkage 250 is attached to both the string depressor 240 and the support arm 220. In use, the control linkage 250 may provide support for aligning the contoured string depressor 240 and preventing unwanted lateral slippage of the contoured string depressor 240, with respect to the neck 9. Connections from the control linkage 250 to both the support arm 220 and the string depressor 240 are made in a manner that allows for retractable movement (e.g., rotatable bolting, pinning, riveting, or other such connections).

Figure 7:
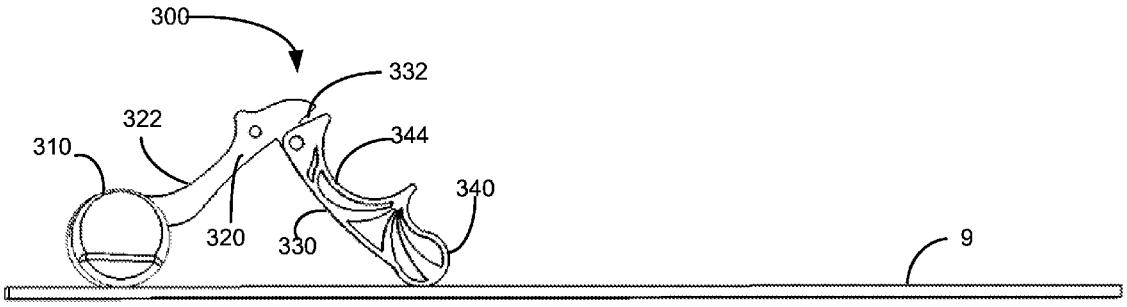
FIG. 7 is a side view of an example device for altering tonal characteristics of output of a stringed instrument, in accordance with yet another embodiment.
Figure 8:
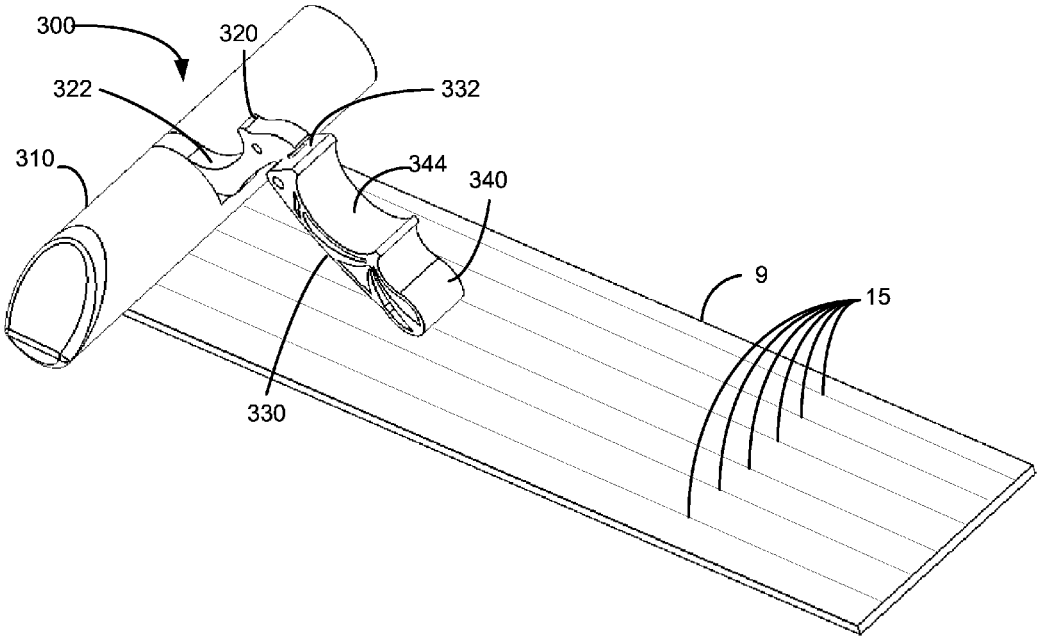
FIG. 8 is a perspective view of the example device for altering tonal characteristics of output of a stringed instrument in accordance with the embodiment of FIG. 7.

Finally, FIGS. 7 and 8 show yet another embodiment of an apparatus 300 for altering the tonal characteristics of the output 17, 18 of the stringed instrument 5. The apparatus 300 includes a bar 310, similar to the bar 110 of FIGS. 2 and 3, which may be comparable to any design used for a standard slide bar, as described above in more detail with respect to FIGS. 2 and 3. In some examples, the bar 310 may have a contoured surface, which may provide a comfortable grip against a palm of a user's hand. In addition to the bar 310, the apparatus 300 includes a support arm 320. The support arm 320 may include a finger rest 322, which may be a groove in the structure at the intersection of the bar 310 and support arm 320 at which a user of the apparatus 300 may rest one or more fingers (e.g., an index finger) while using the apparatus 300. The support arm 320 is attached to the bar 310 by any suitable method of attachment (e.g., bolting, welding, adhesively attaching, forming synchronously with the bar, etc.).

The apparatus 300 further includes movable arm 330 hinged to the support arm 320 at pivot 332. The pivot 332 may be spring biased to hold the movable arm 330 in any desired starting position when a user has not applied pressure to the movable arm 330. For example, the pivot 332 may spring bias the movable arm 330 to a forward-extended position. A user may pivotally reposition the movable arm 330 by applying pressure at a thumb stop 334, on which the user may rest his/her thumb, or any other fingers, during use.

However, as opposed to the first two embodiments which include a contoured string depressor which pivots independently of the movable arm, in this embodiment, the moveable arm itself depresses the strings. More specifically, for depressing one or more strings 15 associated with the neck 9 at a location forward of the bar 310, the movable arm 330 may include a string depressor 340 at its distal end. In use, the string depressor 340 may be moved forward along the neck 9 without moving the bar 310, as the movable arm 330 is retractable with respect to the support arm 320. In some examples, a thumb stop 344 may be used by the user as a point of contact with which to move the movable arm 330, which, in turn, may position the location of its string depressor 340.

INDUSTRIAL APPLICABILITY

From the foregoing, it can be seen that the technology disclosed herein has industrial applicability in a variety of settings such as, but not limited to, apparatus and methods for altering the tonal characteristics of a stringed musical instrument. The disclosed embodiments of the apparatus 100, 200, 300 provide great improvement over the prior art by allowing for greater manipulation of the tonal characteristics of the output. By using the retractable string depressor 140, 240, 340, a user can manipulate the tonal characteristics of the output beyond that of a standard slide bar by depressing one or more strings at a location forward of the bar 110, 210, 310.

In use, the string depressors 140, 240, 340 may be used to depress one or more strings on the neck 9, the one or more depressed strings being depressed at a location forward of the bar 110, 210, 310. By depressing the one or more strings at a point forward of the bar 110, 210, 310, the retractable string depressor 140, 240, 340 may be used to alter the tonal characteristics of the output 17, 18 of the musical instrument 5. Using the apparatus 100, 200, 300, the user may alter the tonal output 17, 18 by creating different chord combinations having one or more strings 15 depressed forward of the bar 110, 210, 310. Not only can the user alter the tonal output 17, 18, but relative to the prior art, can do so much more consistently and reliably without as much ultimate reliance on the dexterity of the user.

Figure 9:
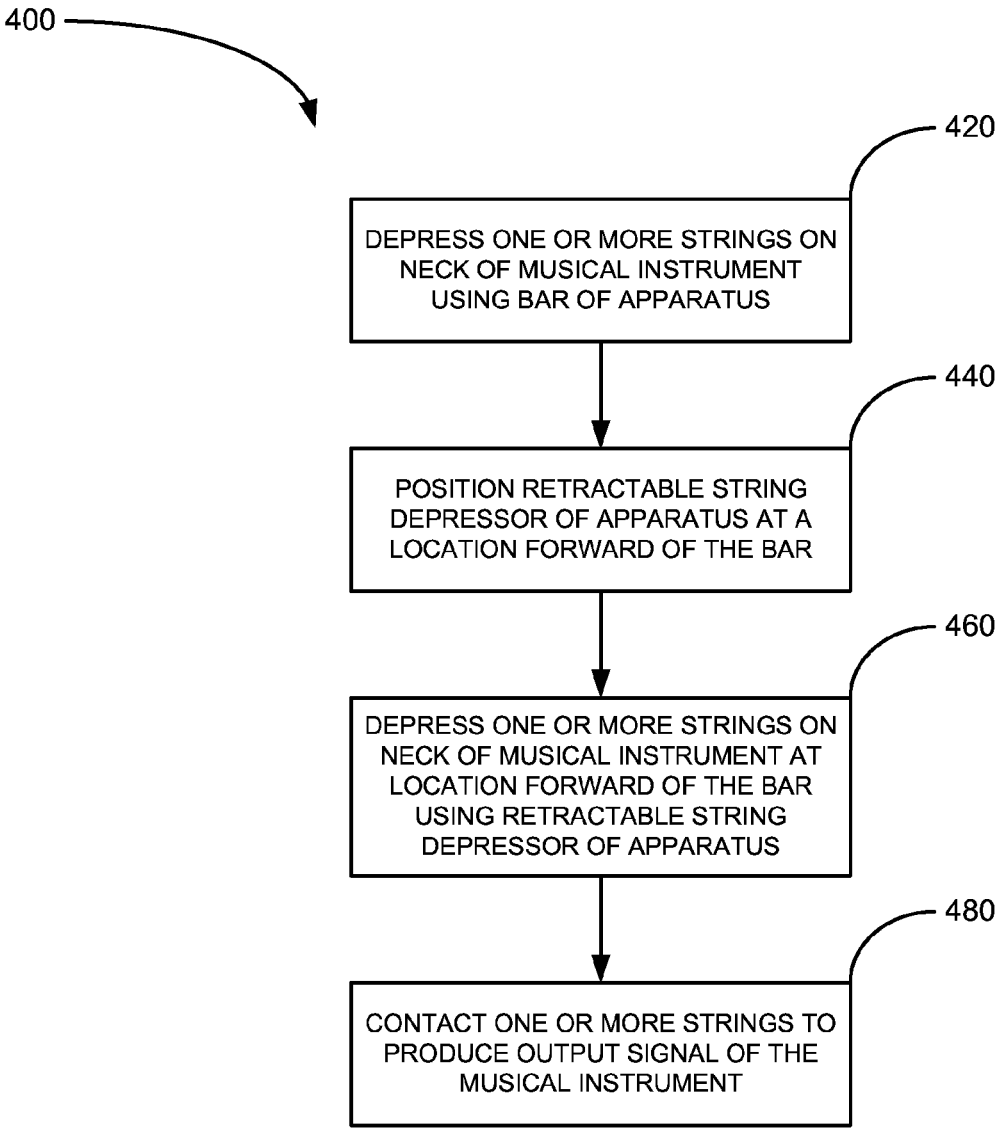
FIG. 9 is a flowchart for an example method for altering tonal characteristics of output of a stringed instrument in accordance with the present disclosure.

An example method 400 for using an apparatus 100, 200, 300 to alter the tonal characteristics of output of a stringed musical instrument while playing said instrument is shown in FIG. 9. The method begins when a user depresses one or more of the strings 15 at a location on the neck 9 using the bar 110, 210, 310 of the apparatus 100, 200, 300 (block 420). The bar 110, 210, 310 may be held in the fingers and palm of a left hand, for example. The retractable string depressor 140, 240, 340 may then be positioned at the location on the neck 9 forward of bar 110, 210, 310 by moving the retractable string depressor 140, 240, 340 with respect to the bar 110, 210, 310 (block 440). The user then depresses one or more of the strings depressed by the bar 110, 210, 310 at a location forward of the bar 110, 210, 310, using the retractable string depressor 140, 240, 340 (block 460). For example, if holding in said left hand, the depressor 140, 240, 340 may be pivoted downwardly using the thumb, of said left hand. Output 17, 18 may then be produced when the user makes contact (e.g., strumming, plucking, etc.) with one or more of the strings 7 (block 480).

It will be appreciated that the present disclosure provides apparatus and methods for altering the tonal characteristics of the output of a stringed musical instrument. While only certain embodiments have been set forth, alternatives and modifications will be apparent from the above description to those skilled in the art. These and other alternatives are considered equivalents and within the spirit and scope of this disclosure and the appended claims.

What is claimed is:

1. An apparatus for altering the tonal characteristics of output of a stringed instrument, the stringed instrument including a neck and a plurality of strings, the plurality of strings disposed about the neck, the apparatus comprising;

a slide bar for contacting one or more strings of the plurality of strings;

a support arm attached to the slide bar; and a retractable string depressor pivotally connected to the support arm, the string depressor adapted to depress one or more strings of the plurality of strings at a location on the neck forward of the slide bar.

2. The apparatus of claim 1, further comprising a movable arm for retractably connecting the string depressor to the support arm.

3. The apparatus of claim 1, further comprising a finger rest formed at an intersection of the slide bar and the support arm.

4. The apparatus of claim 1, further comprising a thumb rest associated with the retractable string depressor.

5. The apparatus of claim 2, wherein the movable arm includes a thumb rest.

6. The apparatus of claim 1, wherein the retractable string depressor includes a contoured contact surface.

7. The apparatus of claim 1, wherein the retractable string depressor is retractably attached to the support arm using a spring-biased pivot.

8. An apparatus for altering the tonal characteristics of output of a stringed instrument, the stringed instrument including a neck and a plurality of strings, the plurality of strings disposed about the neck, the apparatus comprising;

a slide bar for contacting one or more strings of the plurality of strings;

a support arm attached to the slide bar;

a movable arm attached to the support arm; and a retractable string depressor pivotally connected to the movable arm, the retractable string depressor for depressing one or more strings of the plurality of strings at a location on the neck forward of the slide bar.

9. The apparatus of claim 8, further including a control linkage attached to both the support arm and the retractable string depressor.

10. The apparatus of claim 8, wherein the movable arm includes a thumb rest.

11. The apparatus of claim 10, wherein the retractable string depressor is repositionable using the thumb rest.

12. The apparatus of claim 8, wherein the support arm and the movable arm are attached via a spring biased pivot.

13. The apparatus of claim 8, further comprising a finger rest formed at an intersection of the slide bar and the support arm.

14. The apparatus of claim 8, wherein the retractable string depressor includes a contoured contact surface.

15. The apparatus of claim 14, wherein the contoured contact surface is contoured to a shape emulating a human finger.

16. The apparatus of claim 14, wherein the contoured contact surface includes a substantially flat surface and a substantially arced surface.

17. A method for altering the tonal characteristics of output of a stringed instrument, the stringed instrument including a neck and a plurality of strings, the plurality of strings disposed about the neck, the method comprising:

depressing one or more strings of the plurality of strings using a slide bar;

positioning a retractable string depressor to a location forward of the slide bar on the neck, the retractable string depressor being in pivotal connection with the slide bar;

depressing one or more strings at the location forward of the slide bar on the neck using the retractable string depressor.

18. The method of claim 17, wherein the retractable string depressor is in connection with the slide bar via a support arm.

19. The method of claim 17, wherein the retractable string depressor is in connection with the slide bar via a support arm and a movable arm, the movable arm attached to the support arm and the support arm attached to the slide bar and the retractable string depressor.

20. The method of claim 17, wherein the positioning of the retractable string depressor is performed using a thumb stop associated with the retractable string depressor.

* * * * *